US008319689B2

(12) United States Patent
Kim et al.

(10) Patent No.: US 8,319,689 B2
(45) Date of Patent: Nov. 27, 2012

(54) PATCH ANTENNA WITH WIDE BANDWIDTH AT MILLIMETER WAVE BAND

(75) Inventors: Dong-Young Kim, Daejeon (KR); Hae Cheon Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 321 days.

(21) Appl. No.: 12/633,466

(22) Filed: Dec. 8, 2009

(65) Prior Publication Data

US 2011/0057853 A1 Mar. 10, 2011

(30) Foreign Application Priority Data

Sep. 8, 2009 (KR) ..... 10-2009-0084400

(51) Int. Cl.
*H01Q 1/38* (2006.01)

(52) U.S. Cl. ..... 343/700 MS; 343/843

(58) Field of Classification Search ..... 343/843, 343/700 MS
See application file for complete search history.

(56) References Cited

U.S. PATENT DOCUMENTS

| | | | | |
|---|---|---|---|---|
| 6,346,913 | B1 * | 2/2002 | Chang et al. | 343/700 MS |
| 2006/0256016 | A1 | 11/2006 | Wu et al. | |
| 2007/0080864 | A1 * | 4/2007 | Channabasappa | 343/700 MS |
| 2007/0262828 | A1 * | 11/2007 | Fujita | 333/26 |
| 2008/0068269 | A1 * | 3/2008 | Yamada | 343/700 MS |

FOREIGN PATENT DOCUMENTS

| | | | |
|---|---|---|---|
| JP | 01-135107 | A | 5/1989 |
| JP | H10-303618 | A | 11/1998 |
| JP | 2002-217613 | A | 8/2002 |
| JP | 2003-332830 | A | 11/2003 |
| JP | 2004-072417 | A | 3/2004 |
| JP | 2005-286484 | A | 10/2005 |
| JP | 2007-235236 | A | 9/2007 |
| KR | 2000-0017029 | A | 3/2000 |
| KR | 2009-0023364 | A | 3/2009 |

OTHER PUBLICATIONS

Tomohiro Seki et al. "Microstrip Array Antenna with Parasitic Elements Alternately Arranged Over Two Layers of LTCC Substrate for Millimeter Wave Applications" Radio and Wireless Symposium, 2007 IEEE, pp. 149-152.

* cited by examiner

*Primary Examiner* — Dieu H Duong
(74) *Attorney, Agent, or Firm* — Rabin & Berdo, P.C.

(57) ABSTRACT

Provided is a millimeter wave band patch antenna. The patch antenna includes a multi-layer substrate, at least one metal pattern layer, an antenna patch, a ground layer, and a plurality of vias. In the multi-layer substrate, a plurality of dielectric layers are stacked. The metal pattern layer is disposed between the dielectric layers except for a center region of the multi-layer substrate. The antenna patch is disposed on an upper surface of the multi-layer substrate in the center region. The ground layer is disposed on a lower surface of the multi-layer substrate opposing to the upper surface. The vias is disposed around the center region through the dielectric layers for electrically connecting the metal pattern layer to the ground layer. The center region, which is surrounded by the ground layer and the vias, functions as a resonator.

19 Claims, 12 Drawing Sheets

PATCH ANTENNA WITH WIDE BANDWIDTH AT MILLIMETER WAVE BAND

CROSS-REFERENCE TO RELATED APPLICATIONS

This U.S. non-provisional patent application claims priority under 35 U.S.C. §119 of Korean Patent Application No. 10-2009-0084400, filed on Sep. 8, 2009, the entire contents of which are hereby incorporated by reference.

BACKGROUND OF THE INVENTION

The present invention disclosed herein relates to a patch antenna with wide bandwidth at millimeter wave band, and more particularly, to a high-gain, high-efficiency, wideband millimeter wave band patch antenna constructed on a multi-layer substrate.

Frequencies of the millimeter wave band are more straightforward and have wideband characteristics as compared with those of micro wave band, thereby drawing attention in application to radars and communication services. Particularly, since wavelengths of the millimeter wave band are short, it is easy to manufacture small antennas and thus reduce system sizes largely. Among communication services in the millimeter wave band, 60-GHz broadband communication services and 77-GHz vehicle radar services have been fairly commercialized, and products thereof are now available on the market.

To provide small and inexpensive products by using the merits of millimeter wave band systems, much research is being conducted on system on package (SOP) systems. Among methods of constructing such SOPs, a method of using a low temperature co-fired ceramic (LTCC) or liquid crystal polymer (LCP) technique is considered to be one of most suitable methods. According to an LTCC or LCP technique, basically, a multi-layer substrate is used, and passive devices such as a capacitor, an inductor, and a filter are built in the substrate, so that small and inexpensive modules can be provided. Another merit of using such a multi-layer substrate is that cavities can be freely formed, and thus the freedom of module configuration increases.

In the structure of an SOP system, an antenna patch is considered to a core element determining the system performance. In the case of a patch antenna operating in the millimeter wave band, particularly, ultrahigh frequency band of 60 GHz or higher, signal leakage occurs in the form of surface waves propagating along the surface of a dielectric substrate of the patch antenna. Such signal leakage increases as the thickness of the substrate increases and the dielectric constant of the substrate increases. Such signal leakage decreases the radiation efficiency and gain of the patch antenna. Although 60-GHz band communication systems require a wide bandwidth of 7 GHz or wider, it is difficult to satisfy such requirement by using a typical patch antenna structure.

Current commercial millimeter wave band modules have an SOP structure constructed by using an LTCC technique to reduce manufacturing costs. However, a ceramic substrate such as an LTCC substrate has higher dielectric constant than an organic substrate, and thus, if the ceramic substrate is used to form the patch antenna, since the radiation efficiency and gain of the patch antenna are low as described above, the number of antenna arrays should be much increased to obtain desired antenna gain, and it is difficult to obtain desired wideband characteristics. Therefore, commercial products are manufactured in a manner such that only antenna patches are formed of organic substrates having low dielectric constant.

Thus, the size and manufacturing costs of modules are increased as compared with the case where the entire system including the antenna patch is mounted on an LTCC substrate in the form of an SOP.

SUMMARY OF THE INVENTION

The present invention provides a patch antenna configured to suppress signal leakage in the form of surface waves along the surface of a dielectric substrate, provide wideband characteristics, and reduce the size and manufacturing costs of modules.

The present invention is not limited to the aforesaid, but other facts not described herein will be clearly understood by those skilled in the art from descriptions below.

Embodiments of the present invention provide patch antennas may include: a multi-layer substrate in which a plurality of dielectric layers are stacked; at least one metal pattern layer disposed between the dielectric layers except for a center region of the multi-layer substrate; an antenna patch disposed on an upper surface of the multi-layer substrate in the center region of the multi-layer substrate; a ground layer disposed on a lower surface of the multi-layer substrate opposing to the upper surface of the multi-layer substrate; and a plurality of vias disposed around the center region through the dielectric layers for electrically connecting the metal pattern layer to the ground layer, wherein the center region of the multi-layer substrate, surrounded by the ground layer and the vias, functions as a dielectric resonator.

In some embodiments, the vias may be spaced from each other by a distance equal to or shorter than about half the wavelength of radiation of the antenna patch.

In other embodiments, the vias may function as a metal wall suppressing leakage of a signal accumulated in the center region.

In still other embodiments, the vias may include at least one additional via disposed radially to the center region.

In even other embodiments, transmission of surface waves may be suppressed as a distance between the upper surface of the multi-layer substrate and the ground layer is reduced owing to the vias.

In yet other embodiments, the vias may include a conductive metal.

In further embodiments, the center region may be sized so that resonance occurs in a design frequency band and act as a dielectric resonator.

In still further embodiments, a horizontal section of the center region may have any shape which can make a resonance at a designed frequency band.

In even further embodiments, bandwidth of the patch antenna may be widened according to coupling between the antenna patch and the center region.

In yet further embodiments, a horizontal section of the antenna patch may have any shape which can make a resonance at a designed frequency band.

In some embodiments, the antenna patch may include a conductive metal.

In other embodiments, the multi-layer substrate may include a low temperature co-fired ceramic (LTCC) or a liquid crystal polymer (LCP).

In still other embodiments, the metal pattern layer may include a plurality of line patterns extending radially from the center region. Each of the line patterns may correspond to the vias.

In even other embodiments, the metal pattern layer may include a conductive metal.

In yet other embodiments, the ground layer may include a conductive metal.

In further embodiments, the patch antenna may further include a transmission line configured to supply a signal to the antenna patch.

In still further embodiments, the patch antenna may further include additional vias disposed around a lower side of the transmission line.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
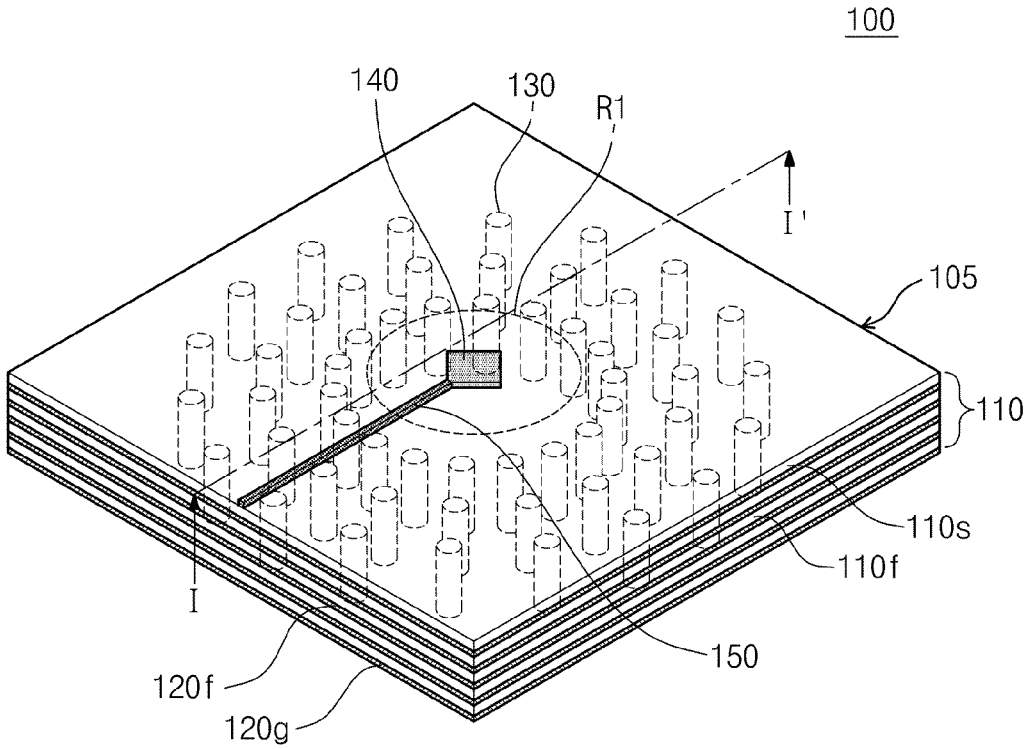
FIG. 1 is a perspective view illustrating a millimeter wave band patch antenna according to a first embodiment of the present invention.

The present invention will now be described more fully with reference to the accompanying drawings, in which exemplary embodiments of the invention are shown. The attached drawings for illustrating preferred embodiments of the present invention are referred to in order to gain a sufficient understanding of the present invention, the merits thereof, and the objectives accomplished by the implementation of the present invention. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. Like reference numerals refer to like elements throughout.

In the following description, the technical terms are used only for explaining a specific exemplary embodiment while not limiting the present invention. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components. Since preferred embodiments are provided below, the order of the reference numerals given in the description is not limited thereto. These terms are only used to distinguish one element from another element. It will also be understood that when a layer (or film) is referred to as being 'on' another layer or substrate, it can be directly on the other layer or substrate, or intervening layers may also be present.

Additionally, the embodiment in the detailed description will be described with sectional views and/or plan views as ideal exemplary views of the present invention. In the figures, the dimensions of layers and regions are exaggerated for clarity of illustration. Accordingly, shapes of the exemplary views may be modified according to manufacturing techniques and/or allowable errors. Therefore, the embodiments of the present invention are not limited to the specific shape illustrated in the exemplary views, but may include other shapes that may be created according to manufacturing processes. For example, an etched region illustrated as a rectangle may have rounded or curved features. Areas exemplified in the drawings have general properties, and are used to illustrate a specific shape of a semiconductor package region. Thus, this should not be construed as limited to the scope of the present invention.

Figure 2:
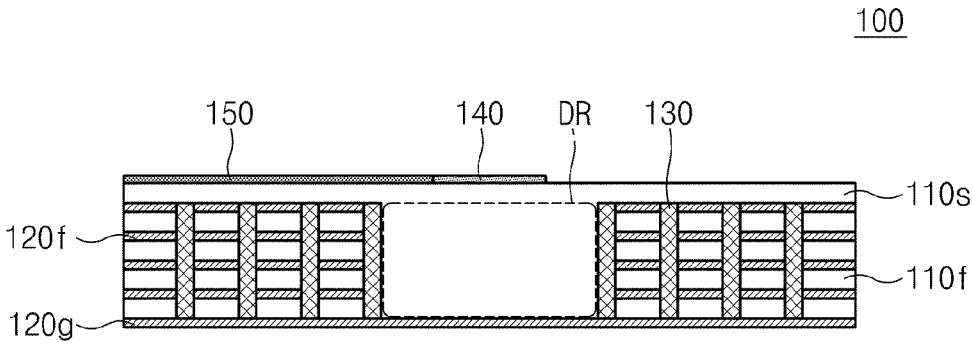
FIG. 2 is a sectional view taken along line I-I' of FIG. 1.

FIG. 1 is a perspective view illustrating a millimeter wave band patch antenna according to a first embodiment of the present invention, and FIG. 2 is a sectional view taken along line I-I' of FIG. 1.

Referring to FIGS. 1 and 2, a patch antenna 100 includes: a multi-layer substrate 105 in which a plurality of dielectric layers 110*f* and 110*s* (inner dielectric layers 110*f* and a surface dielectric layer 110*s*) are stacked; metal pattern layers 120*f* disposed between the dielectric layers 110*f* and 110*s* except for an center region R1 of the multi-layer substrate 105; an antenna patch 140 disposed on an upper surface of the multi-layer substrate 105 in the center region R1; a ground layer 120*g* disposed on a lower surface of the multi-layer substrate 105 opposing to the upper surface of the multi-layer substrate 105; and a plurality of vias 130 formed through the inner dielectric layers 110*f* around the center region R1 so as to connect the metal pattern layers 120*f* to the ground layer 120*g*. The center region R1 of the multi-layer substrate 105 surrounded by the ground layer 120*g* and the vias 130 may function as a resonator. That is, in the current embodiment of the present invention, the patch antenna 100 may be constituted by the antenna patch 140 disposed on the upper surface of the multi-layer substrate 105, and a dielectric resonator DR disposed in the center region R1 of the multi-layer substrate 105. The center region R1 and the dielectric resonator DR may have the same horizontal section area and shape.

The multi-layer substrate 105 may include a low temperature co-fired ceramics (LTCC) or a liquid crystal polymer (LCP). The multi-layer substrate 105 may be formed by stacking the plurality of dielectric layers 110*f* and 110*s* having high dielectric constant and sintering the dielectric layers 110*f* and 110*s*.

The metal pattern layers 120*f* may include a conductive metal. For example, the metal pattern layers 120*f* may be formed of silver (Ag). The metal pattern layers 120*f*, which are disposed between the dielectric layers 110*f* and 110*s* except for the center region R1 of the multi-layer substrate 105, may be formed on the dielectric layers 110*f* by a method such as a printing method.

That is, the multi-layer substrate 105 including the metal pattern layers 120*f* may be formed by disposing a metal pattern layer 120*f* on a dielectric layer 110*f*; disposing another dielectric layer 110*f* on the lower dielectric layer 110*f* where the metal pattern layer 120*f* is disposed; disposing another metal pattern layer 120*f* on the dielectric layer 110*f*; repeating these processes; and finally, disposing a surface dielectric layer 110*s*.

The antenna patch 140 may include a conductive metal. For example, the antenna patch 140 may be formed of silver (Ag). The antenna patch 140 may be formed on the upper surface of the multi-layer substrate 105 (the surface dielectric layer 110*s*) by a method such as a printing method. The antenna patch 140 may have various shapes. This will be described later in other embodiments of the present invention.

The ground layer 120*g* may include a conductive metal. For example, the ground layer 120*g* may be formed of silver (Ag). The ground layer 120*g* may be formed on the lower surface of the multi-layer substrate 105 (the lowermost dielectric layer 110*f*) by a method such as a printing method.

The vias 130 may include a conductive metal. For example, the vias 130 may be formed of silver (Ag). The vias 130 may be formed around the center region R1 of the multi-layer substrate 105 by forming via holes through the inner dielectric layers 110*f* and the metal pattern layers 120*f* before forming the surface dielectric layer 110*s*, and filling the via holes with a conductive metal. The via holes may be formed by a method such as punching. Punching can be used because the dielectric layers 110*f* and 110*s* are flexible before they are sintered. The patch antenna 100 may be formed by: disposing the surface dielectric layer 110*s* after forming the vias 130; disposing the antenna patch 140 and the ground layer 120*g* on the upper and lower surfaces of the multi-layer substrate 105, respectively; and sintering the resultant structure.

Since the metal pattern layers 120*f* and the ground layer 120*g* are electrically connected to each other through the vias 130, the distance from the upper surface of the multi-layer substrate 105 to the ground layer 120*g* can be reduced. Therefore, signal leakage in the form of surface waves at the antenna patch 140 can be reduced.

The vias 130 surrounding the center region R1 of the multi-layer substrate 105 may be spaced from each other by a length equal to or shorter than about half ($\lambda/2$) the wavelength of radiation of the antenna patch 140. In this case, radiation (having a wavelength $\lambda$) of the antenna patch 140 cannot propagate between the vias 130. Therefore, signal leakage from the antenna patch 140 in the form of surface waves can be accumulated in the dielectric resonator DR.

In addition to the vias 130 surrounding the center region R1 of the multi-layer substrate 105, additional vias 130 may be arranged in the center region R1 of the multi-layer substrate 105 in radial directions. In this case, wavelengths radiating from the antenna patch 140 may be difficult to propagate to the outside of the center region R1.

The center region R1 may be sized so that resonance can occur in a design frequency band of the patch antenna 100.

According to the coupling between the antenna patch 140 and the center region R1, the bandwidth of the antenna patch 140 may be increased. Therefore, the coupling between the antenna patch 140 and the center region R1 can be adjusted to give wideband characteristics to the patch antenna 100. The center region R1 may have various shapes. This will be described later in other embodiments of the present invention.

The patch antenna 100 may further include a transmission line 150 to supply signal to the antenna patch 140. The transmission line 150 may have various shapes such as a microstrip shape, coaxial probe shape, an aperture-coupled shape, or a proximity-coupled shape.

In FIGS. 1 and 2, a microstrip transmission line 150 is illustrated. The microstrip transmission line 150 may include a conductive metal. For example, the microstrip transmission line 150 may be formed of silver (Ag). The microstrip transmission line 150 may be formed on the upper surface of the multi-layer substrate 105 (the surface dielectric layer 110*s*) in contact with the antenna patch 140 by a method such as a printing method. Since the microstrip transmission line 150 and the antenna patch 140 are electrically connected, the microstrip transmission line 150 and the antenna patch 140 may be formed together.

Additional vias 130 may be disposed in the multi-layer substrate 105 around the lower part of the microstrip transmission line 150. In this case, similarly to the above description, the distance from the upper surface of the multi-layer substrate 105 to the ground layer 120*g* can be reduced, and thus signal leakage from the microstrip transmission line 150 in the form of surface waves can be reduced.

In the structure of the patch antenna 100 of the current embodiment, since the antenna patch 140 is distant from the ground layer 120*g*, the impedance of the antenna patch 140 can be suitable for radiation, and in the region outside the dielectric resonator DR located in the center region R1 of the multi-layer substrate 105, the distance between the upper surface of the multi-layer substrate 105 and the ground layer 120*g* can be shortened owing to the vias 130.

Generally, as the microstrip transmission line 150 becomes distant from the ground layer 120*g*, that is, as the thickness of the multi-layer substrate 105 increases, surface waves are easily transmitted, and thus, in the current embodiment, it is configured such that the ground layer 120*g* is close to the microstrip transmission line 150 in the region outside the antenna patch 140 so as to suppress transmission of surface waves in the region outside the antenna patch 140. Therefore, signal leakage from the antenna patch 140 in the form of surface waves are not transmitted to the outside but can be accumulated in the dielectric resonator DR. If the dielectric resonator DR is sized so that resonance can occur in a design frequency band, resonating signals can radiate to the outside of the multi-layer substrate 105, and thus the radiation efficiency and antenna gain of the patch antenna 100 can be increased. In addition, if the antenna patch 140 is properly coupled with the dielectric resonator DR disposed in the multi-layer substrate 105, the bandwidth of the patch antenna 100 can be widened, and thus the patch antenna 100 can have wideband characteristics.

Figure 3:
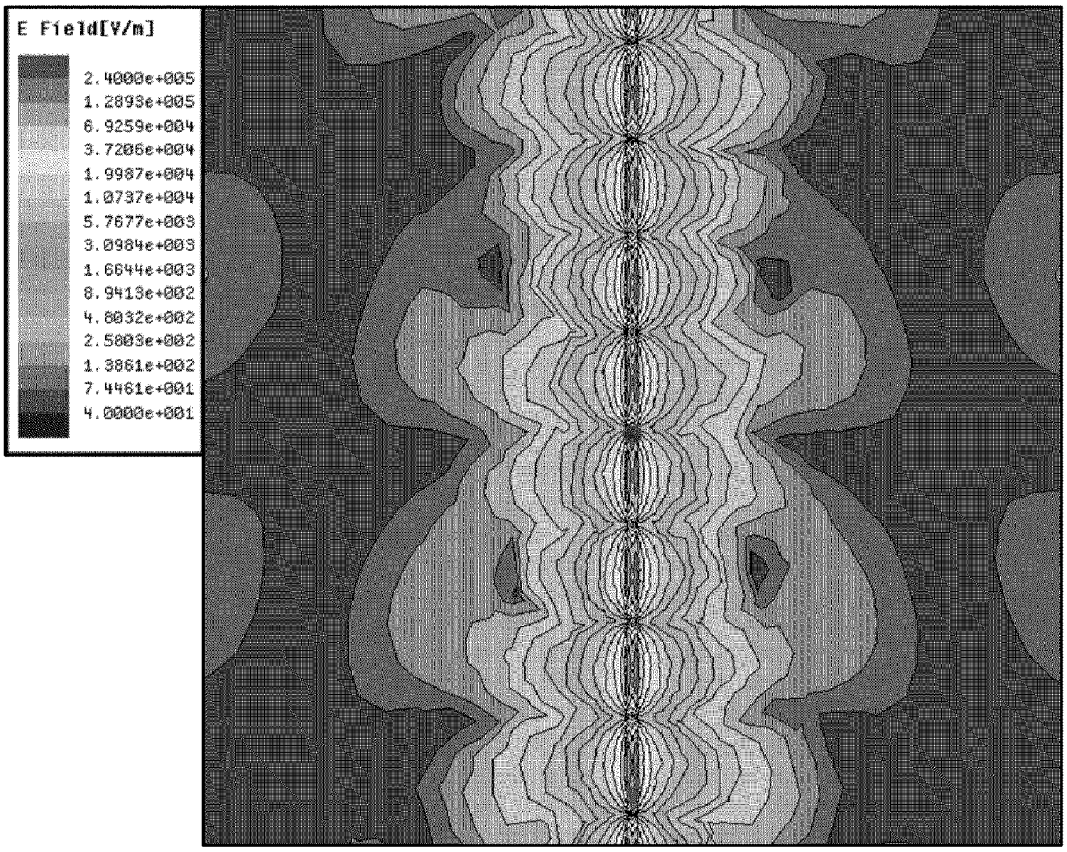
FIGS. 3 and 4 are graphs illustrating electric fields distributions on the surfaces of substrates when signals are transmitted to microstrip transmission lines of millimeter wave band patch antennas including dielectric layers having different thicknesses.
Figure 4:
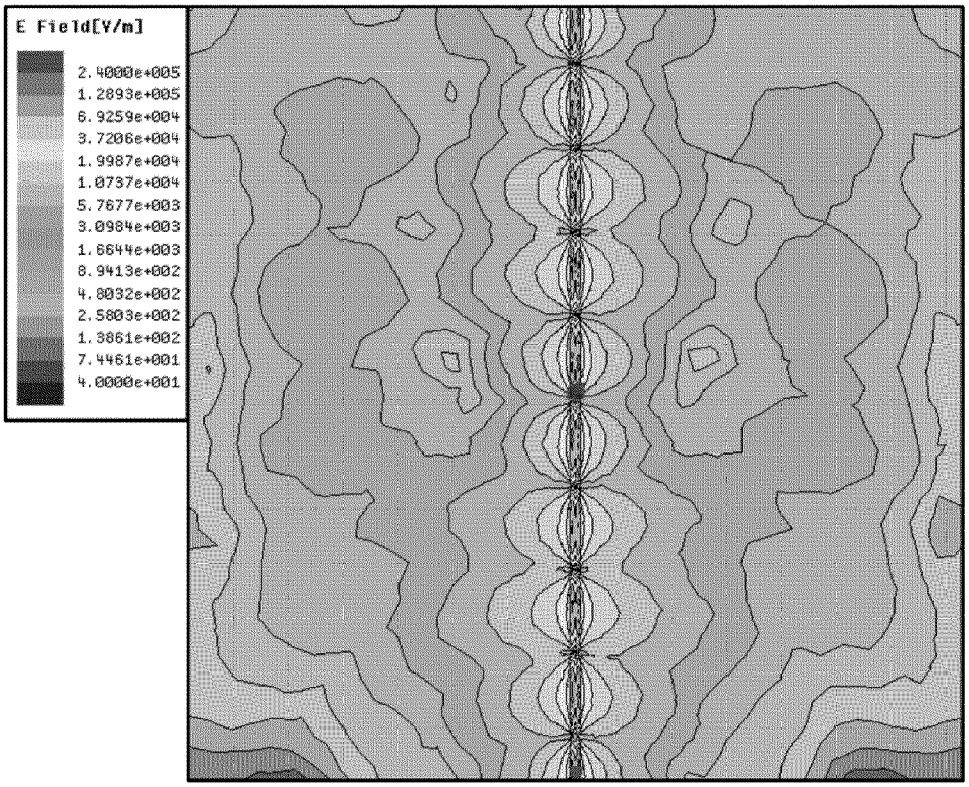

FIGS. 3 and 4 are graphs illustrating electric fields distributions on the surfaces of substrates when signals are transmitted to microstrip transmission lines of millimeter wave band patch antennas including dielectric layers having different thicknesses.

Referring to FIG. 3, when a signal is transmitted to a microstrip transmission line (refer to the microstrip transmission line 150 illustrated in FIG. 1) disposed on a multi-layer substrate including a dielectric layer (refer to the dielectric layer 110*f* or 110*s* illustrated in FIG. 1) having a thickness of 0.1 mm, the distribution of an electric field is concentrated around the microstrip transmission line. That is, the electric field is steeply weakened as it goes away from the microstrip transmission line.

Referring to FIG. 4, when a signal is transmitted to a microstrip transmission line disposed on a multi-layer substrate including a dielectric layer having a thickness of 0.5 mm, unlike the case of FIG. 3 where the thickness of the dielectric layer is smaller, an electric field is further distributed to a region distant from the microstrip transmission line. This means that the electric field leaks along the surface of the multi-layer substrate, and such leakage of the electric field increases as the thickness of the dielectric layer increases.

In a patch antenna (refer to the patch antenna 100 illustrated in FIG. 1), it is ideal that a supplied signal radiates from an antenna patch (refer to the antenna patch 140 illustrated in FIG. 1), however, as the dielectric constant of a dielectric layer increases or the thickness of the dielectric layer increases, more surface waves leak along the surface of a multi-layer substrate, and thus the radiation efficiency and gain of the patch antenna are decreased.

Figure 5:
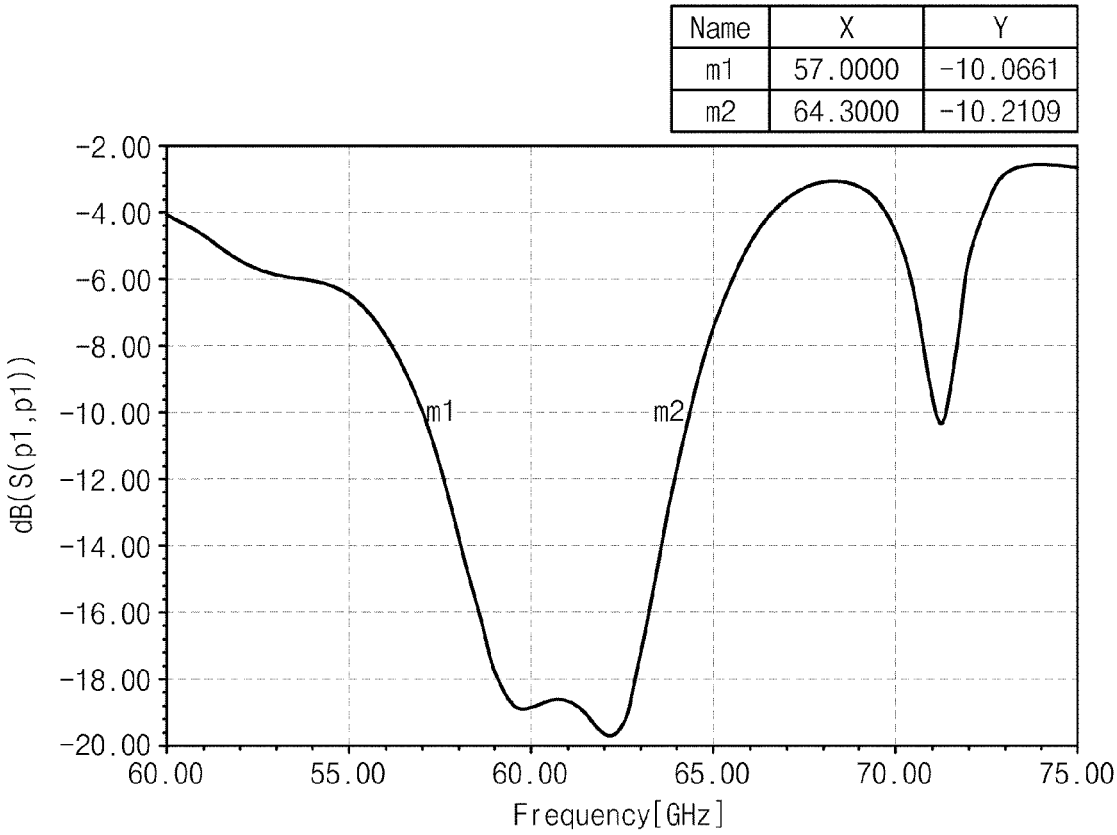
FIG. 5 is a graph for explaining the reflection characteristics of a millimeter wave band patch antenna according to the first embodiment of the present invention.
Figure 6:
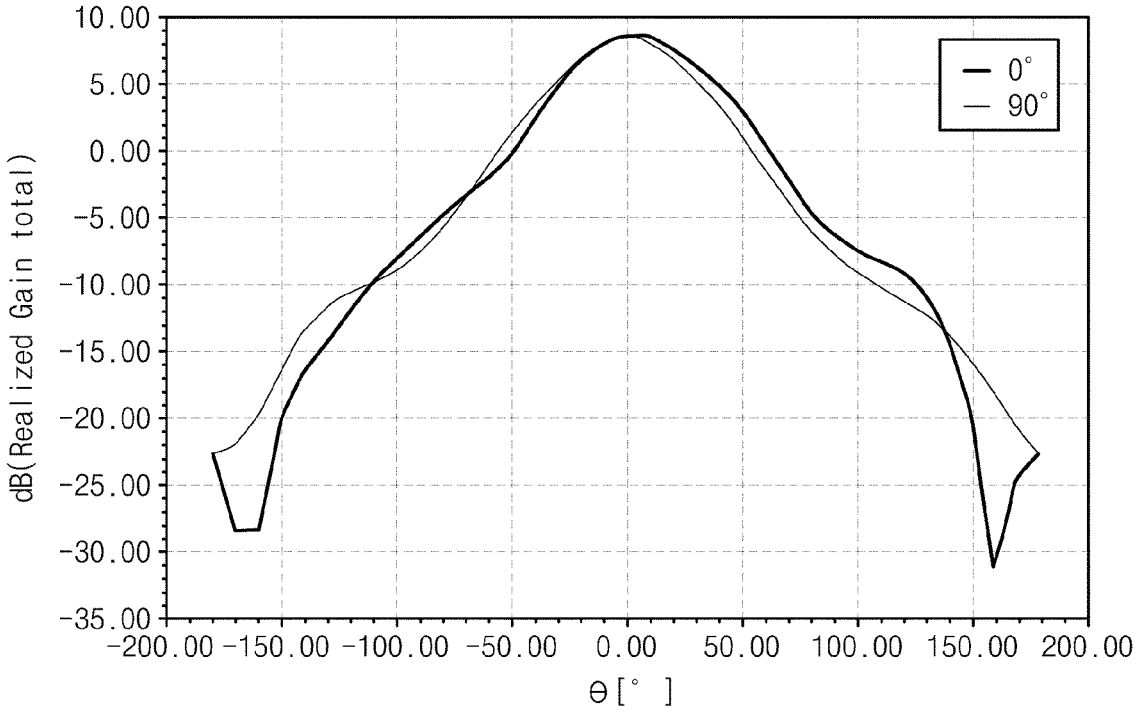
FIG. 6 is a graph for explaining the radiation characteristics of a millimeter wave band patch antenna according to the first embodiment of the present invention.

FIGS. 5 and 6 are graphs for explaining the reflection characteristics (S11) and radiation characteristics (antenna gain) of a millimeter wave band patch antenna according to the first embodiment of the present invention.

FIGS. 5 and 6 illustrate results of electromagnetic field simulation experiments carried out by using a high frequency simulation software (HFSS) so as to look into the reflection and radiation characteristics of a millimeter wave band patch antenna (refer to the patch antenna 100 illustrated in FIG. 1). S11 of S-parameters (scattering parameters) is shown. Sll means the ratio of the intensity of a wave input to an input port and the intensity of the wave reflected to the input port.

The patch antenna has a dielectric constant of 7.2, and in the patch antenna, a rhombus antenna patch is disposed on the upper surface of a multi-layer substrate (refer to the multi-layer substrate 105 illustrated in FIG. 1) formed by stacking five dielectric layers (refer to the dielectric layers 110*f* and 110*s* illustrated in FIG. 1) having a thickness of 0.1 mm. A dielectric resonator (refer to the dielectric resonator DR illustrated in FIG. 1), which is disposed in the multi-layer substrate and surrounded by a ground layer (refer to the ground layer 120*g* illustrated in FIG. 1) and a wall or fence formed by a plurality of vias (refer to the vias 130 illustrated in FIG. 1), may be lower than the upper surface of the multi-layer substrate by a one-layer thickness and have a cylindrical shape having a thickness of four dielectric layers.

The rhombus antenna patch is sized such that a resonance frequency exists in 60-GHz band.

Referring to FIG. 5, the bandwidth of the patch antenna is 57.0 to 64.3 GHz (m1-m2), and the bandwidth of the antenna patch is 7.3 GHz. In the case of a typical patch antenna having the same structure of the patch antenna of the current embodiment of the present invention except that the typical patch antenna does not has metal pattern layers (refer to the metal pattern layers 120*f* illustrated in FIG. 1) and a plurality of vias connecting the metal pattern layers to the ground layer, the bandwidth of the typical patch antenna was 58.0 to 61.8 GHz, and the bandwidth of an antenna patch was 3.8 GHz. That is, the wideband characteristics of the patch antenna of the current embodiment are improved as compared with those of the typical patch antenna.

Referring to FIG. 6, the maximum gain of the patch antenna is 8.2 dBi. In addition, the gains of the patch antenna in the perpendicular and parallel directions to a transmission line (refer to the transmission line 150 illustrated in FIG. 1) are approximately the same. This is due to suppressing of signal leakage, which occurs in the form of surface waves radiating along the surface of the multi-layer substrate. Furthermore, according to the simulation results, the radiation efficiency of the patch antenna is about 67.8%.

Generally, the gain of a patch antenna having a single-layer substrate is maximal in a direction perpendicular to the single-layer substrate. However, the gain of the typical patch antenna mentioned in FIG. 5 was maximal at an angle θ of about −15° from the direction perpendicular to a multi-layer substrate. In addition, the radiation characteristics of the typical patch antenna were predicted to be approximately the same in the perpendicular and parallel directions to a transmission line because the typical patch antenna has a rhombus antenna patch, however, although the gain of the typical patch antenna was symmetric in the direction perpendicular to the transmission line, the gain of the typical patch antenna was shifted by about 15° and not symmetric in the direction parallel with the transmission line. The reason for this is that leakage signals radiate along the surface of the multi-layer substrate in the form of surface waves. In addition, according to the simulation results, the radiation efficiency of the typical patch antenna was about 32.8%.

That is, the patch antenna of the current embodiment of the present invention has significantly improved gain and radiation efficiency as compared with the typical patch antenna.

Figure 7:
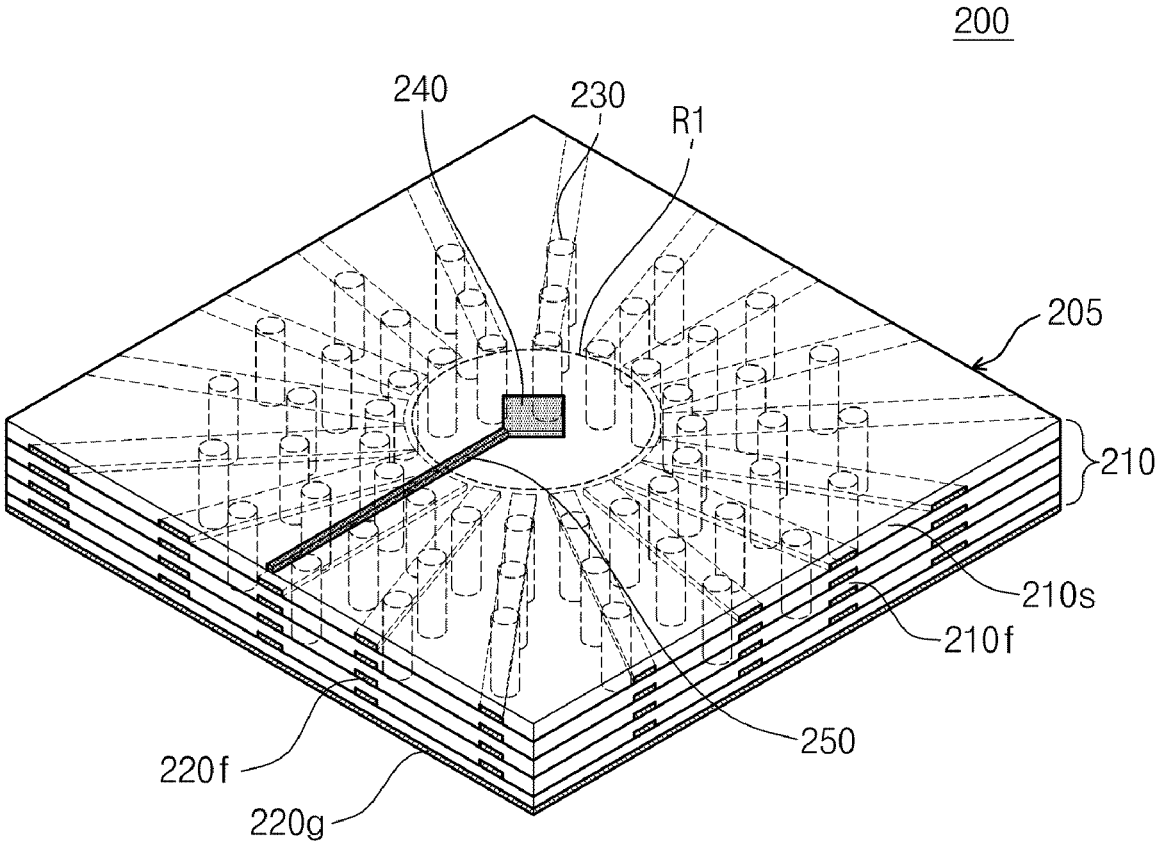
FIG. 7 is a perspective view illustrating a millimeter wave band patch antenna according to a second embodiment of the present invention.
Figure 8:
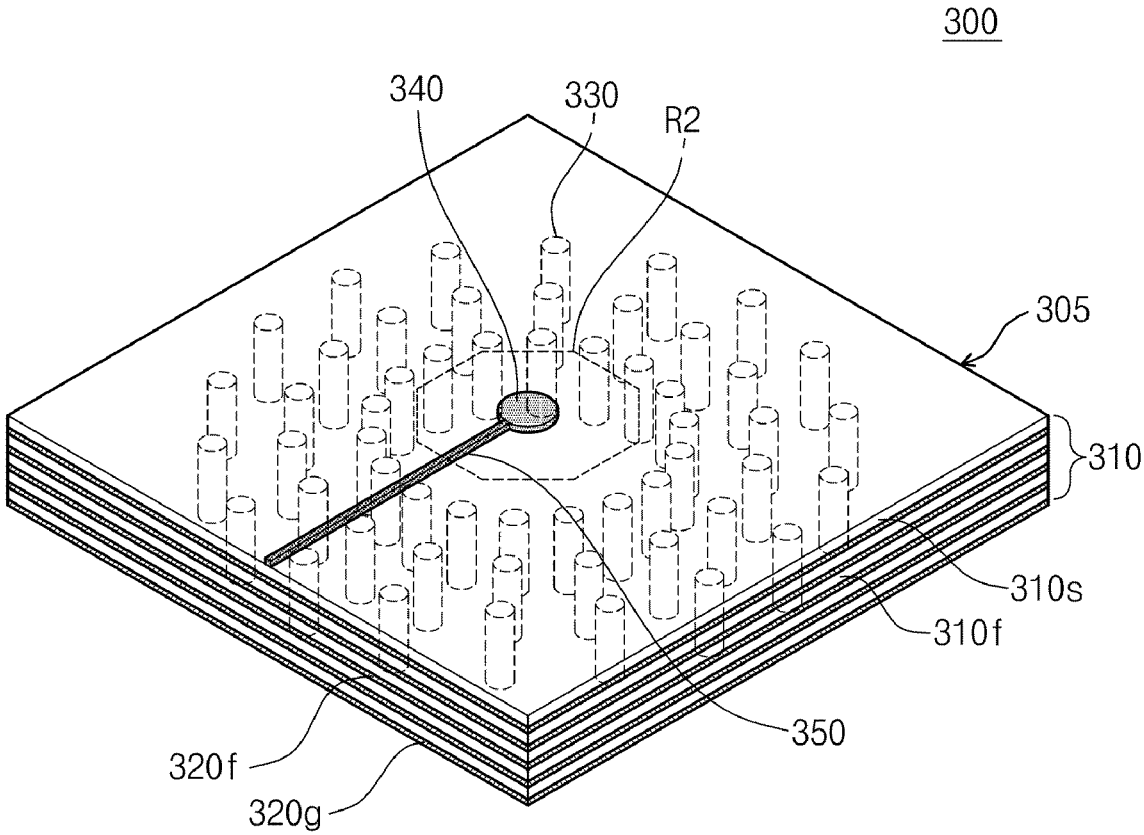
FIG. 8 is a perspective view illustrating a millimeter wave band patch antenna according to a third embodiment of the present invention.
Figure 9:
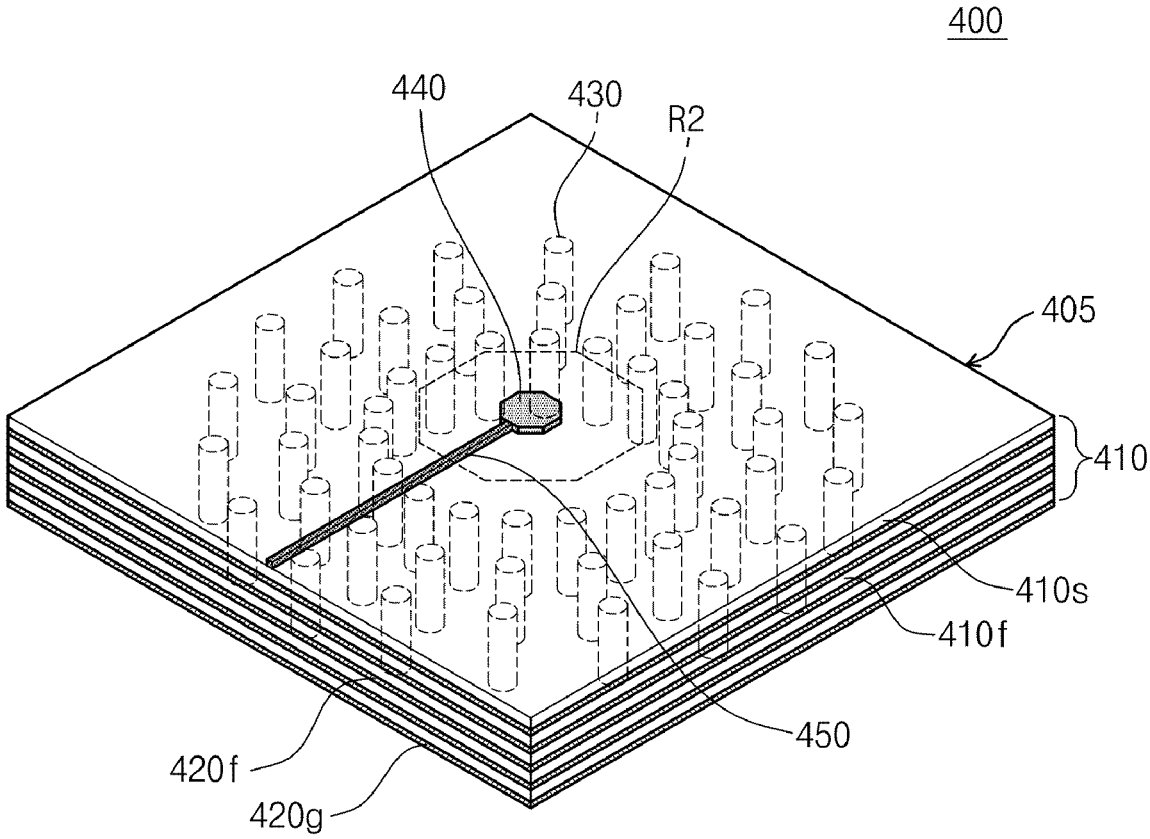
FIG. 9 is a perspective view illustrating a millimeter wave band patch antenna according to a fourth embodiment of the present invention.
Figure 10:
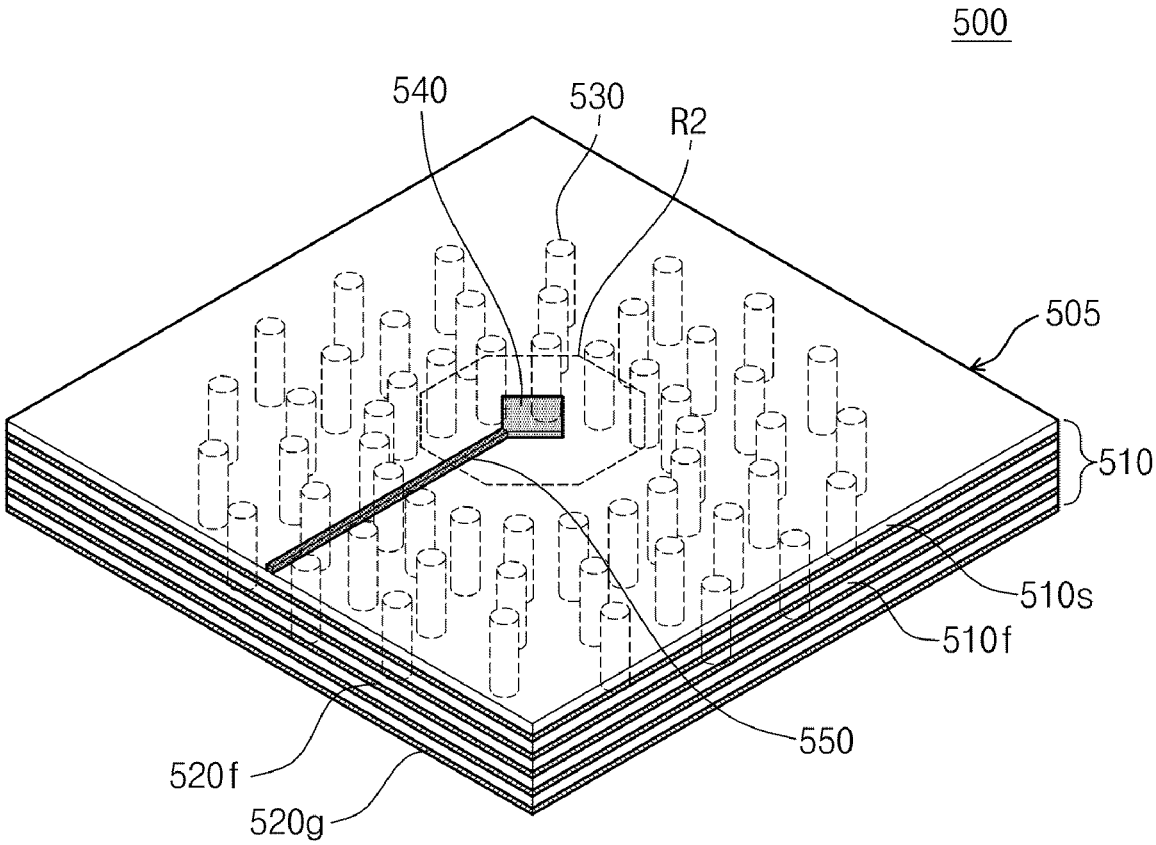
FIG. 10 is a perspective view illustrating a millimeter wave band patch antenna according to a fifth embodiment of the present invention.
Figure 11:
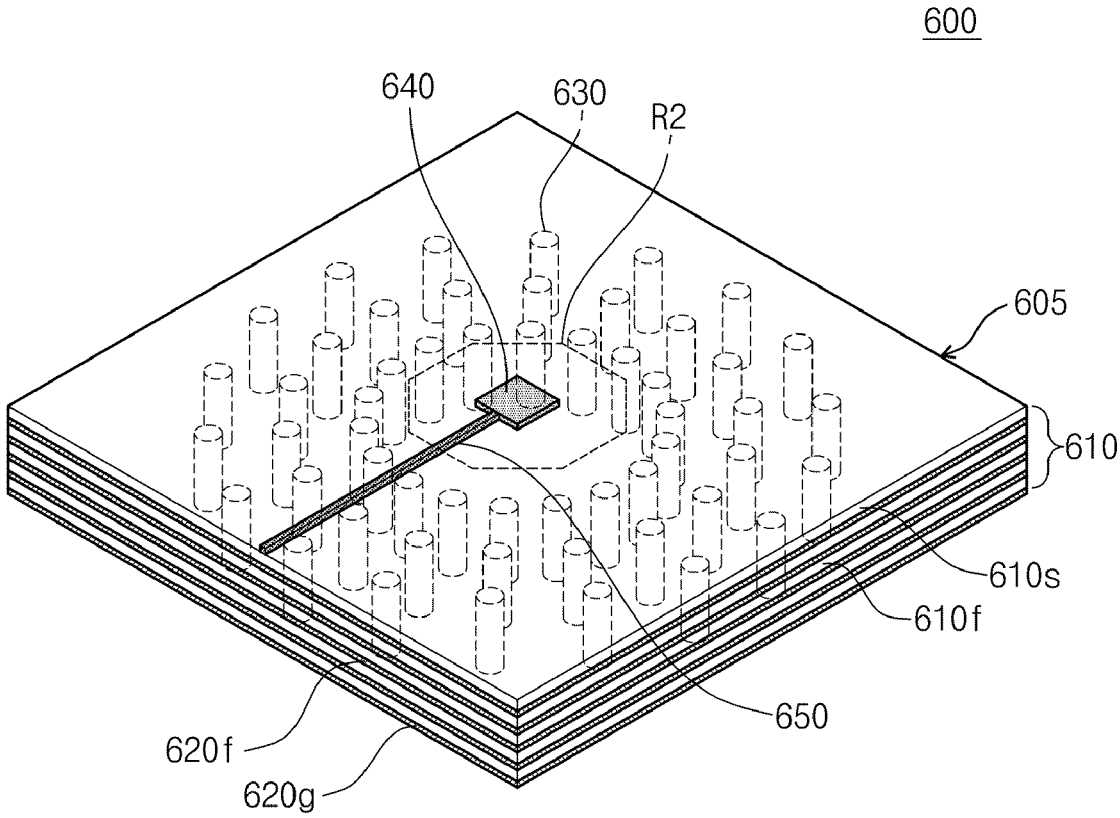
FIG. 11 is a perspective view illustrating a millimeter wave band patch antenna according to a sixth embodiment of the present invention.

FIG. 7 is a perspective view illustrating a millimeter wave band patch antenna according to a second embodiment of the present invention.

Referring to FIG. 7, a patch antenna 200 of the current embodiment has metal pattern layers 220*f* different from the metal pattern layers 120*f* of the first embodiment illustrated in FIG. 1. The metal pattern layers 220*f* may be a plurality of line patterns extending radially from a center region R1 of a multi-layer substrate 205.

As described above in FIGS. 1 and 2, a plurality of vias 230 surrounding the center region R1 of the multi-layer substrate 205 are spaced from each other by about half (λ/2) the wavelength of radiation of an antenna patch 240, and thus radiation (having a wavelength λ) of the antenna patch 240 cannot propagate between the vias 230. That is, by using only the vias 230 surrounding the center region R1 of the multi-layer substrate 205, signal leakage from the antenna patch 240 in the form of surface waves can be directed to a dielectric resonator DR (refer to the dielectric resonator DR illustrated in FIG. 2) for accumulating the leaking signals in the dielectric resonator DR.

However, to shorten the distance between an upper surface of the multi-layer substrate 205 and a ground layer 220*g* for suppressing signal leakage in the form of surface waves along a microstrip transmission line 250, it may be necessary to locate the metal pattern layers 220*f* in the multi-layer substrate 205 at least under the microstrip transmission line 250. Thus, the metal pattern layers 220*f* can be line patterns.

FIGS. 8 through 11 are perspective views illustrating millimeter wave band patch antennas according to third to sixth embodiments of the present invention.

Referring to FIGS. 8 through 11, patch antennas 300, 400, 500, and 600 may include center regions R2 in which dielectric resonators having octagon-shaped horizontal sections are included, and antenna patches 340, 440, 540, and 640 having circular, rhombus, octagon, and square horizontal sections are respectively included. Alternatively, the patch antennas 300, 400, 500, and 600 may include antenna patches having other shapes such as ring, rectangular, and triangular shapes (not shown).

The characteristics of the patch antennas 300, 400, 500, and 600 are shown in Table 1 below.

TABLE 1

| Antenna patch shapes | Bandwidth (GHz) | Antenna gain (dBi) | Antenna efficiency (%) |
|---|---|---|---|
| Circular | 7.3 (57.6-64.9) | 8.05 | 67.1 |
| Octagon | 7.4 (57.5-64.9) | 7.97 | 67.1 |
| Rhombus | 7.1 (57.0-64.1) | 8.60 | 68.1 |
| Square | 4.8 (57.2-62.0) | 9.09 | 67.3 |

As shown in Table 1, the patch antennas 300, 400, 500, and 600 have high gains, high efficiencies, and wideband characteristics, which are not largely varied according to the shapes of the antenna patches 340, 440, 540, and 640.

Figure 12:
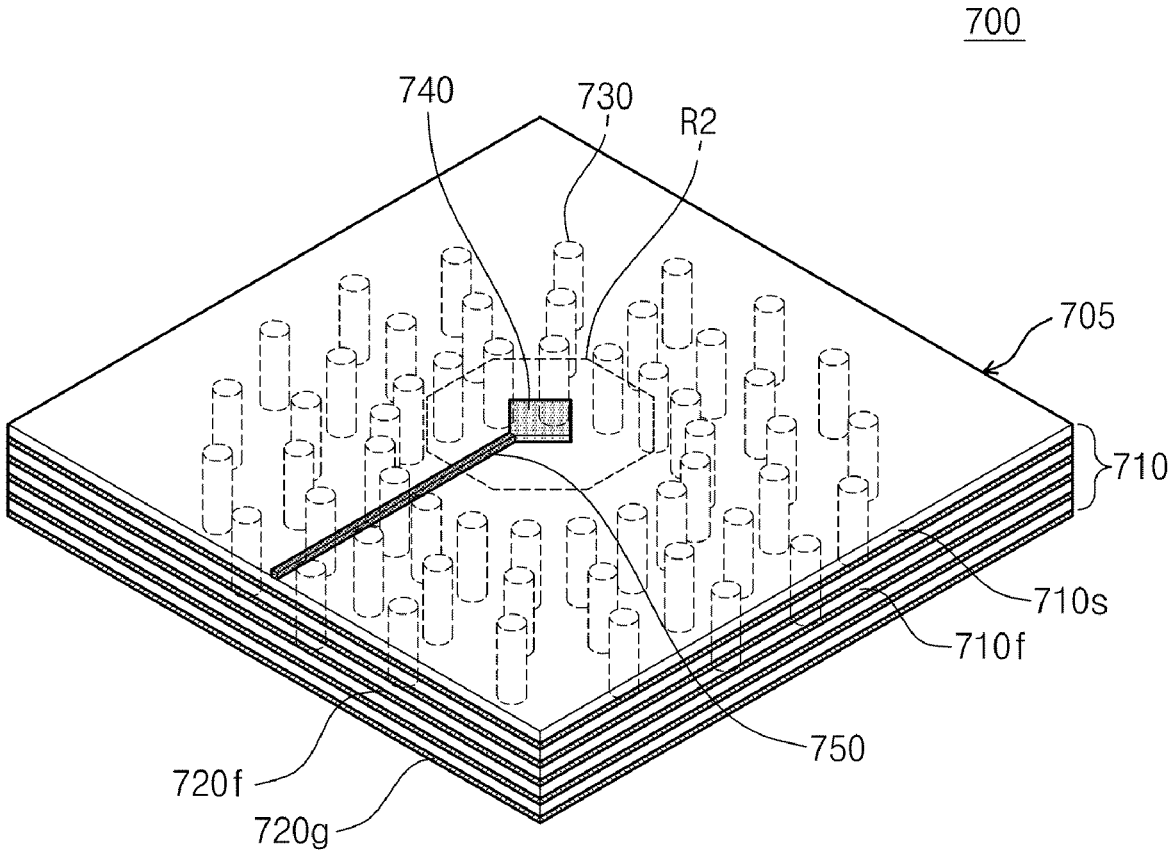
FIG. 12 is a perspective view illustrating a millimeter wave band patch antenna according to a seventh embodiment of the present invention.
Figure 13:
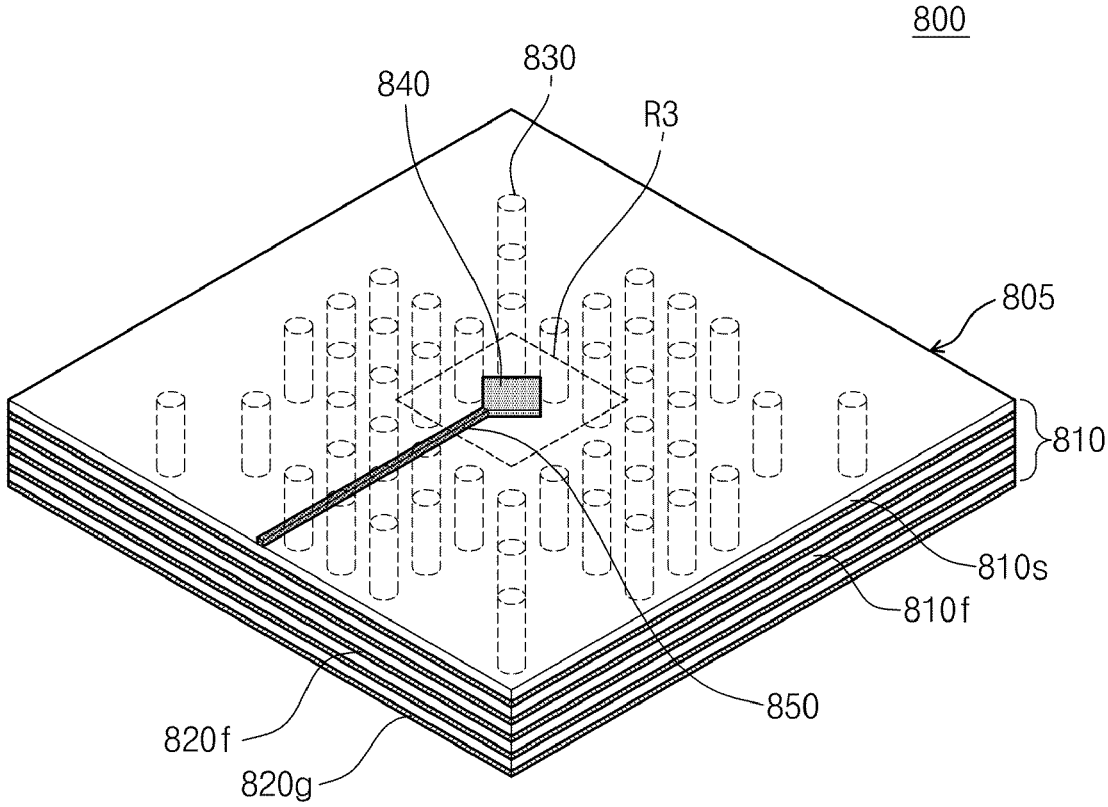
FIG. 13 is a perspective view illustrating a millimeter wave band patch antenna according to an eighth embodiment of the present invention.

FIGS. 12 and 13 are perspective views illustrating millimeter wave band patch antennas according to seventh and eighth embodiments of the present invention.

Referring to FIGS. 1, 12 and 13, patch antennas 100, 700, and 800 may include patch antennas 140, 740, and 840 having rhombus-shaped horizontal sections, and center regions R1, R2, and R3 in which dielectric resonators having circular, octagon, and square horizontal sections are respectively included. Alternatively, the patch antennas 100, 700, and 800 may include dielectric resonators having other shapes such as a regular polygon (not shown).

The characteristics of the patch antennas 100, 700, and 800 are shown in Table 2 below.

TABLE 2

| Resonator shapes | Bandwidth (GHz) | Antenna gain (dBi) | Antenna efficiency (%) |
|---|---|---|---|
| Circular | 7.3 (57.0-64.3) | 8.41 | 67.8 |
| Octagon | 7.1 (57.0-64.1) | 8.60 | 68.1 |
| Square | 8.4 (54.5-62.9) | 8.88 | 65.0 |

As shown in Table 2, the patch antennas 100, 700, and 800 have high gains, high efficiencies, and wideband characteristics, which are not largely varied according to the shapes of the resonators in the center regions R1, R2, and R3.

According to the above-described embodiments of the present invention, since the patch antennas include an antenna patch and a dielectric resonator disposed under the antenna patch and surrounded by metal, the distance between the antenna patch and a ground layer can be increased. As a result, the impedance of the antenna patch can be suitable for radiation, and the distance between the upper surface of a multi-layer substrate and the ground layer can be shortened in a region outside the dielectric resonator disposed in the multi-layer substrate.

According to the embodiments of the present invention, in the patch antennas, the distance of the ground layer and a transmission line is close, and thus transmission of surface waves can be suppressed. Therefore, signal leakage from the antenna patch in the form of surface waves are not transmitted to the outside but are accumulated in the dielectric resonator. Thus, if the dielectric resonator is sized so that resonance can occur in a design frequency band, resonating signals can radiate to the outside of the multi-layer substrate, and thus the radiation efficiency and gain of the patch antenna can be increased. In addition, by properly adjusting the coupling between the antenna patch and the dielectric resonator disposed in the multi-layer substrate, the bandwidth of the patch antenna can be widened. In this way, there can be provided a high-gain, high-efficiency, wideband millimeter wave band patch antenna constructed on a multi-layer substrate in which dielectric layers are stacked.

As described above, according to the present invention, in the multi-layer substrate, a region surround by the ground layer and a wall formed by vias can function as a resonator. Therefore, surface waves leaking from the antenna patch along the surface of the multi-layer substrate are difficult to propagate in the region outside the resonator due to the reduced distance between the surface of the multi-layer substrate and the ground layer, so that the surface waves can be accumulated in the resonator.

As a result, signals leaking to the outside along the surface of the multi-layer substrate can be significantly reduced, and signals accumulated in the resonator can radiate to the outside. Thus, the radiation efficiency and gain of the patch antenna can be improved.

In addition, the bandwidth of the patch antenna can be widened by properly adjusting the coupling between the antenna patch and the resonator. That is, according to the present invention, a patch antenna having wide band characteristics can be provided.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A patch antenna comprising:

a multi-layer substrate in which a plurality of dielectric layers are stacked, the multi-layer substrate having a center region, a first surface and a second surface opposite the first surface;

at least one metal pattern layer disposed between the dielectric layers except for the center region;

an antenna patch disposed on the first surface and in the center region;

a ground layer disposed on the second surface; and a first plurality of vias disposed around the center region through the dielectric layers for electrically connecting the at least one metal pattern layer to the ground layer, wherein the center region has a resonator portion, that is surrounded by the ground layer and the vias, that functions as a resonator, wherein the vias are spaced from each other by a distance equal to or shorter than about half the wavelength of radiation of the antenna patch, wherein the resonator portion is disposed between the ground layer and the antenna patch such that the ground layer and the antenna patch are disposed on opposite sides of the resonator portion relative to each other, and the ground layer is on a line that is perpendicular to a surface of the antenna patch.

2. The patch antenna of claim 1, wherein the vias function as a metal wall suppressing leakage of a signal accumulated in the center region.

3. The patch antenna of claim 1, wherein the vias comprise at least one additional via disposed radially to the center region.

4. The patch antenna of claim 1, wherein transmission of surface waves is suppressed as a distance between the first surface and the ground layer is reduced because of the vias.

5. The patch antenna of claim 1, wherein the center region is sized so that resonance occurs in a design frequency band.

6. The patch antenna of claim 5, wherein the center region surrounded by the vias acts as a dielectric resonator at the design frequency band.

7. The patch antenna of claim 1, wherein bandwidth of the patch antenna is widened according to coupling between the antenna patch and the center region.

8. The patch antenna of claim 1, further comprising a transmission line configured to supply a signal to the antenna patch.

9. The patch antenna of claim 8, further comprising additional vias disposed around a lower side of the transmission line.

10. The patch antenna of claim 8, wherein the transmission line and the antenna patch touch the first surface.

11. The patch antenna of claim 1, wherein the first plurality of vias are equidistant from the center region, each via having two others of the vias disposed within a distance equal to about half the wavelength of the radiation of the antenna patch.

12. The patch antenna of claim 11, further including a second plurality of vias that are equidistant from the center region and further away from the center region than the first plurality of vias, the number of vias of the second plurality of vias equaling that of the first plurality.

13. The patch antenna of claim 1, wherein the at least one metal pattern layer is grounded only through the ground layer.

14. The patch antenna of claim 1, wherein the first plurality of vias are disposed so that one of the vias is disposed every half of the wavelength or less around the center region so as to encircle the center region.

15. The patch antenna of claim 14, further including a second plurality of vias disposed further away from the center region than the first plurality of vias, the number of vias of the second plurality of vias equaling that of the first plurality.

16. The patch antenna of claim 1, wherein the resonator portion is a dielectric resonator, and the at least one metal pattern layer includes a plurality of metal pattern layers that are arranged to be disposed between a top surface and a bottom surface of the dielectric resonator.

17. The patch antenna of claim 1, wherein the at least one metal pattern layer is disposed between the ground layer and the antenna patch.

18. The patch antenna of claim 1, wherein one of the dielectric layers, that is disposed between the resonator portion and the antenna patch, has a first dielectric surface and a second dielectric surface, that is the first surface of the multilayer substrate, opposite the first dielectric surface, the resonator portion touching the first dielectric surface and the antenna patch touching the second dielectric surface.

19. The patch antenna of claim 1, wherein said surface of the antenna patch touches one of the dielectric layers.

* * * * *